US007913929B2

(12) United States Patent
Hornby

(10) Patent No.: US 7,913,929 B2
(45) Date of Patent: Mar. 29, 2011

(54) MODULAR OUTWARD OPENING PIEZO DIRECT FUEL INJECTOR

(75) Inventor: Michael J. Hornby, Williamsburg, VA (US)

(73) Assignee: Continental Automotive Systems US, Inc., Auburn Hills ( * ) Notice: Subject to any disclaimer, the term of this patent is extended or adjusted under 35 U.S.C. 154(b) by 255 days.

(21) Appl. No.: 12/292,369

(22) Filed: Nov. 18, 2008

(65) Prior Publication Data

US 2010/0123029 A1 May 20, 2010

(51) Int. Cl.
*F02D 1/06* (2006.01)
*F02D 7/00* (2006.01)

(52) U.S. Cl. ..... 239/5; 239/102.2; 239/584; 310/327; 310/328; 123/498; 29/890.12

(58) Field of Classification Search ..... 239/102.2, 239/5; 251/129.06; 310/326, 328, 348; 123/498
See application file for complete search history.

(56) References Cited

U.S. PATENT DOCUMENTS

| | | | | |
|---|---|---|---|---|
| 4,803,393 | A * | 2/1989 | Takahashi | 310/328 |
| 5,740,969 | A * | 4/1998 | Hoffmann et al. | 239/533.2 |
| 6,729,554 | B2 * | 5/2004 | Katsura et al. | 239/88 |
| 7,044,407 | B2 * | 5/2006 | Fischer et al. | 239/533.7 |
| 7,222,424 | B2 | 5/2007 | Jovovic et al. | |
| 7,309,032 | B2 * | 12/2007 | Fischer et al. | 239/585.1 |
| 7,726,629 | B2 * | 6/2010 | Schurz et al. | 251/129.06 |

* cited by examiner

*Primary Examiner* — Dinh Q Nguyen

(57) ABSTRACT

A module, direct fuel injector (10) includes a fuel side sub-assembly (78) having valve body structure (12, 14) defining a main flow passage (16) there-through, an outlet opening (26) and a seating surface (24). A needle (18) is in the main flow passage and has first and second ends. The second end (22) has a sealing surface (20). The needle is movable between a closed position with the sealing surface engaging the seating surface to prevent fuel from passing through the outlet opening, and an open position. A spring (30) biases the needle to the closed position. Manifold structure (36, 48) is coupled to the valve body structure. The injector also includes a dry side sub-assembly including a piezo stack (42) coupled to the manifold structure and changes length when voltage is applied thereto. The piezo stack is associated with the first end of the needle so that when the length of the piezo stack changes, the needle moves from the closed position to the open position thereof.

16 Claims, 1 Drawing Sheet

MODULAR OUTWARD OPENING PIEZO DIRECT FUEL INJECTOR

TECHNICAL FIELD

The present disclosure relates to a direct fuel injector for supplying fuel to an engine of a vehicle.

BACKGROUND

In today's automotive engine systems, there is an increased demand for low cost, direct fuel injectors with coking resistance. Typical piezo-type fuel injectors for automobiles have outward opening valves that are very fast responding but are costly. Typical direct injector solenoid valves have inward opening valves but they are not resistant to fuel coking. Injector coking is a problem in direct injected internal combustion engines because the injectors are in contact with the harsh environment of the combustion chamber. Due to high temperatures, fuel decomposes in the injector nozzle and lays down a deposit which both restricts flow, and distorts the symmetry of the spray. As this deposit grows with operation, the internal dimensions of the nozzle change.

The buildup of deposits in the combustion chamber can alter engine performance by impairing fuel economy, regulated emissions, and drivability, and in the worst case scenario cause engine damage.

Another disadvantage of conventional fuel injectors is the occurrence of scrap during the manufacturing of the injector.

SUMMARY

There is a need to provide a modular direct fuel injector for an automobile having a piezo stack coupled to an outwardly opening needle valve that allows for fast opening and closing response as well as the ability to measure the combustion pressure using the piezo stack as a sensor.

An object of the invention is to fulfill the need referred to above. In accordance with the principles of the present invention, this objective is achieved by providing a module, direct fuel injector including a fuel side sub-assembly having valve body structure defining a main flow passage there-through and an outlet opening. The valve body structure includes a seating surface at a distal end thereof. A needle is disposed in the main flow passage. The needle has first and second ends, with the second end having a sealing surface associated with the seating surface. The needle is movable between a closed position with the sealing surface engaging the seating surface to prevent fuel from passing through the outlet opening, and an open position with at least a portion of the needle moving outwardly from the distal end of the valve body structure with the sealing surface being disengaged from the seating surface to permit fuel to pass through the outlet opening. A spring, disposed in the main flow passage, is constructed and arranged to bias the needle to the closed position. A manifold structure is coupled to the valve body structure. A portion of the manifold structure has a bore there-through with the first end of the needle extending outwardly from the bore and beyond an end surface of the portion of the manifold structure. The manifold structure includes inlet passage structure in communication with the bore and with the main fuel passage so that fuel supplied to the inlet passage structure will pass through the main flow passage and through the outlet opening when the needle is in the open position. Bellows is provided in the bore and is constructed and arranged to prevent fuel from exiting the bore near the first end of the needle. The injector includes a dry side sub-assembly including a piezo stack coupled to the manifold structure and constructed and arranged to change length when voltage is applied thereto. The piezo stack is associated with the first end of the needle so that when the length of the piezo stack changes, the needle moves from the closed position to the open position thereof.

In accordance with another aspect of an embodiment, the invention, a method of assembling a module, direct fuel injector provides a fuel side sub-assembly having valve body structure defining a main flow passage there-through and an outlet opening. The valve body structure includes a seating surface at a distal end thereof. A needle is disposed in the main flow passage and has first and second ends, with the second end having a sealing surface associated with the seating surface. The needle is movable between a closed position with the sealing surface engaging the seating surface to prevent fuel from passing through the outlet opening, and an open position with at least a portion of the needle moving outwardly from the distal end of valve body structure with the sealing surface being disengaged from the seating surface to permit fuel to pass through the outlet opening. A spring, disposed in the main flow passage, is constructed and arranged to bias the needle to the closed position. Manifold structure is coupled to the upper valve body. A portion of the manifold structure has a bore there-through with the first end of the needle extending outwardly from the bore and beyond an end surface of the portion of the manifold structure. The manifold structure includes inlet passage structure in communication with the bore and with the main fuel passage so that fuel supplied to the inlet passage structure will pass through the main flow passage and through the outlet opening when the needle is in the open position. A pre-deformed crush ring is provided adjacent to the end surface of the portion of the manifold structure. A piezo stack, separate from the fuel side sub-assembly, is coupled to the manifold structure with an end of the piezo stack engaging the crush ring thereby setting a lift of the needle. The piezo stack is constructed and arranged to change length when voltage is applied thereto and being associated with the first end of the needle so that when the length of the piezo stack changes, the needle moves from the closed position to the open position thereof.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF EXAMPLE EMBODIMENTS

Figure 1:
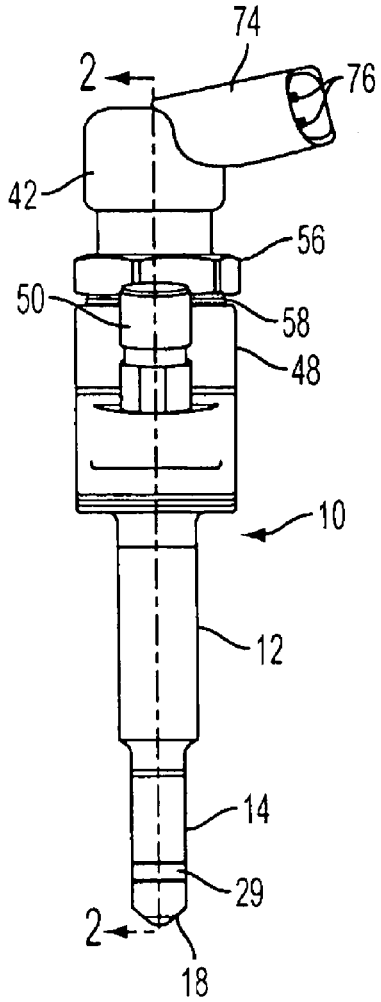
FIG. 1 is a view of a modular, outward opening piezo direct fuel injector provided in accordance with an example embodiment of the present invention.
Figure 3:
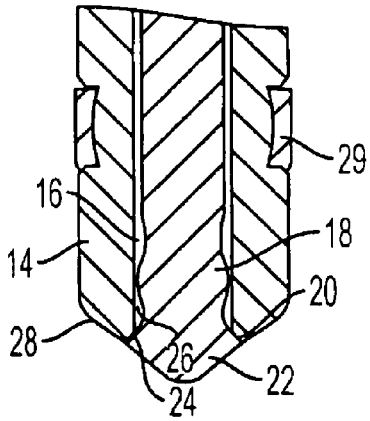
FIG. 3 is an enlarged sectional view of the needle seated in the lower valve body of the injector FIG. 2.

Referring to FIG. 1, a module, outward opening piezo direct fuel injector is shown, generally indicated at 10, for supplying fuel to an internal combustion engine (not shown) of an automobile. The direct fuel injector 10 includes an upper valve body 12, coupled preferably by a laser weld, at one end to a lower valve body 14. The valve bodies 12 and 14 can be considered to be valve body structure that defines a main flow passage 16 of the injector 10. A needle 18 is provided in the flow passage 16 of the valve bodies 12 and 14. The needle 18 is moveable between a first, seated, i.e., closed, position and a second, open position for controlling the flow of fuel through the injector 10. In the closed position as best shown in FIG. 3, an annular sealing surface 20 of an end 22 of the needle 18 is engaged with a mating annular seating surface 24 of the lower valve body 14 thereby closing an outlet opening 26 and preventing fuel flow from the injector 10. In the open position, the needle 18 moves outwardly from the distal end 28 of the lower valve body 14 so that the sealing surface 20 is moved away and disengaged from the seating surface 24 to allow fuel flow through the outlet opening 26. The seating surface 24 is defined at the distal end 28 of the lower valve body 14. A seal 29 is provided near the distal end 28 of the lower valve body 14 in the conventional manner.

An end of a spring 30 rests on an end 32 of the lower valve housing 14 and surrounds a portion of the needle 18 in the upper valve body 14. A retainer 34 retains the other end of the spring 30. The spring 30 biases the needle 18 to the closed position thereof. The retainer 34 and spring 30 are in the main flow passage 16 and when the needle 18 is in the open position, fuel flow about the periphery of the needle 18, the retainer 34 and the spring 30. Since the valve body structure is module due to the separate upper valve body 12 and lower valve body 14, the force of spring 30 on the needle 18 can advantageously be set prior to final assembly of the injector 10.

A body manifold 36 is coupled, preferably by a laser weld, to the other end of the upper valve body manifold 12. The body manifold 36 includes an axially extending bore 38 therethrough and an end 40 of the needle 18 extends through the bore 38 and from end surface 41 of the body manifold 36 to engage a piezo stack 42, the function of which will be explained below. The body manifold 36 includes manifold passages 44. One of the manifold passages 44 communicates with an inlet passage 46 in a fuel manifold 48 that is coupled to the body manifold 36, preferably by a laser weld. Passages 44 and 46 can be considered to be inlet passage structure in communication with the main flow passage 16 of the injector 10 so that fuel can pass through the injector when the needle is in an opened position. An inlet fitting 50 is coupled to the fuel manifold 48 and is sealed with respect thereto via an O-ring 52. Fuel is supplied to the injector 10 via the inlet fitting 50. The fuel manifold 48 also includes mounting structure 54 constructed and arranged to mount the fuel injector 10 to a fuel rail (not shown). The mounting structure 54 is disposed generally 180° from the inlet fitting 50.

Figure 2:
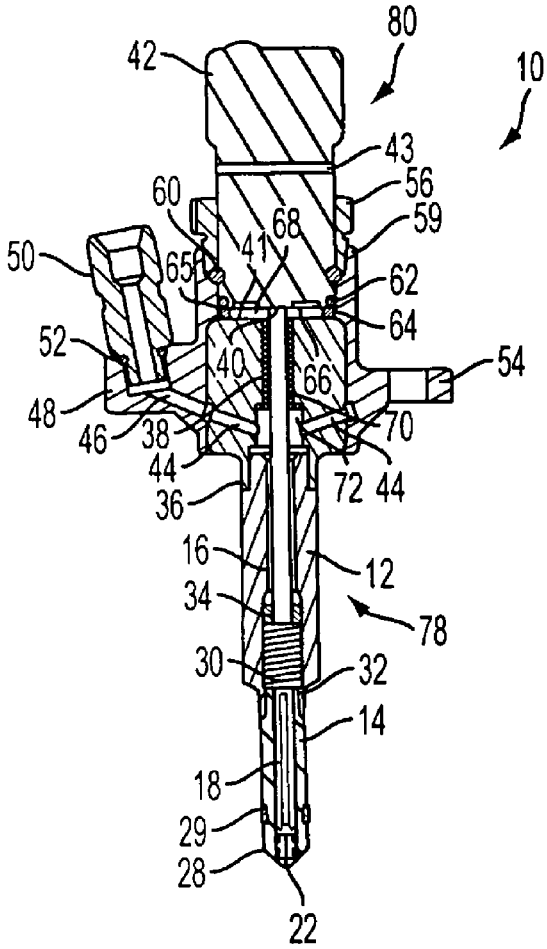
FIG. 2 is a sectional view taken along the line 2-2 of FIG. 1.

The fuel manifold surrounds the body manifold 36. Two inlet passages 46 are provided 180° apart so that the fuel manifold 48 can be mounted 180° from the position shown in FIG. 2, for alternative mounting purposes. The body manifold 36, the fuel manifold 48, and inlet fitting 50 can be considered to be manifold structure and need not be separate parts as in the embodiment.

A thrust nut 56 is provided over the periphery of the piezo stack 42 and external threads 58 of the nut 56 are engaged with internal threads 59 of the fuel manifold 48. A thrust ring 60 is provided such that during assembly, the thrust nut 56 pushes down on the thrust ring 60, which pushes down on the piezo stack 42. An O-ring 62 provides a seal between the piezo stack 42 and the fuel manifold 48. A crush ring 64 is provided in a bore 65 of the fuel manifold 48 and is disposed between an end 66 of the piezo stack 42 and the end 41 of the body manifold 36. The crush ring 64 is preferably pre-deformed to set the blind lift of the needle 18 by controlling the gap 68 between the end surface 41 of the body manifold 36 and the end surface 66 of the piezo stack 42. Blind lift is defined as the small clearance between the needle 18 and the end of the piezo stack 42. As the thrust nut 56 is tightened, minor adjustments to the lift can be made due to minor deformation of the crush ring 64.

A metal bellows 70, disposed in the bore 38 of the body manifold 36, has a first end welded to the needle 18 near end 40 thereof and a second end welded to the body manifold 36. The bellows 70 seals a fuel chamber 72 off hermetically from the unpressurized air filed gap 68. In other words, the bellows 70 separates the dry, piezo stack side from the wet, fuel side of the injector 10. The bellows 70 also permits axial movement of the needle 18. In addition, the bellows diameter and the needle outlet diameter are equal to make the needle pressure balanced. As pressure changes, the force on the needle remains balanced; thus the opening of the needle is not pressure sensitive.

The piezo stack 42 is conventionally used in diesel-type fuel injectors to actuate a valve member and can be of the type disclosed in U.S. Pat. No. 7,222,424, the content of which is hereby incorporated by reference into this specification. More particularly, the piezo stack 42 includes a plurality of stacked, individual piezoelectric elements 43 (only one shown in FIG. 2). Electrical voltage is applied to the piezo stack 42 causing a longitudinal expansion thereof to move the needle 18 downwardly in FIG. 2, to the open position. Removing the voltage returns the piezo stack 42 to its original length and the spring 30 biases the needle 18 back to the closed position thereof. An electrical connector 74 houses the leads 76 for providing the voltage to the piezo stack 42.

The direct fuel injector 10 is of modular configuration so as to reduce parts and to reduce scrap during manufacturing. The assembly of the direct fuel injector 10 includes first building a fuel side sub-assembly, generally indicating at 78, by welding the bellows to the needle and body manifold 36, assembling the upper and lower valve bodies 12, 14 with the needle 18, spring 30 and retainer 34 therein, joining the upper valve body 12 to the body manifold 36, and joining the fuel manifold 48, with inlet fitting 50 attached, to the body manifold 36. The force of spring 30 is set by adjusting the retainer 34 during constructing the fuel side sub-assembly 78. Next, the dry side-sub assembly, generally indicated at 80, is built by assembling the thrust nut 56, the thrust ring 60, and O-ring 62 with respect to the piezo stack 42 and placing the crush ring 64 in the bore 65 of the fuel manifold 48. The threads 58 of thrush nut 56 are engaged with the threads 59 of the fuel manifold 48, with the end surface 66 of the piezo stack 42 engaging the crush ring 64, thereby setting the blind lift of the needle 18 and completing the assembly of the injector 10. Thus, the dry side sub-assembly 80 is separate from the fuel side sub-assembly 78, but coupled therewith.

The fuel manifold 48, body manifold 36, and upper and lower valve bodies 12 and 14 are of stainless steel, thereby defining a stainless steel fuel passage through the injector 10. The modular configuration allows the injector 10 to be calibrated and tested on a sub-assembly basis. In addition, the piezo stack 42 can be manufactured in a place different from where the fuel side sub-assembly 78 is assembled. In addition, the modular configuration enables easy change of fuel injector length and for change in connector types.

Since the injector 10 is outward opening, cocking resistance is improved. The injector 10 can be used in alcohol, gasoline, and flex fuel applications, but conveniently uses a diesel piezo stack 42 mounted above the fuel the passage 16. The injector 10 is of lower cost than conventional outward opening injectors since it has fewer components, less welds, and fewer manufacturing steps than conventional injectors. The use of the dry piezo stack 42 directly coupled to the outwardly opening needle 18 allows for fast opening and closing response as well as the ability to measure the combustion pressure using the piezo stack as a sensor.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A module, direct fuel injector comprising:

a fuel side sub-assembly comprising:

valve body structure defining a main flow passage therethrough and an outlet opening, the valve body structure including a seating surface at a distal end thereof, a needle disposed in the main flow passage, the needle having first and second ends, the second end having a sealing surface associated with the seating surface, the needle being movable between a closed position with the sealing surface engaging the seating surface to prevent fuel from passing through the outlet opening, and an open position with at least a portion of the needle moving outwardly from the distal end of the valve body structure with the sealing surface being disengaged from the seating surface to permit fuel to pass through the outlet opening, a spring, disposed in the main flow passage, constructed and arranged to bias the needle to the closed position, manifold structure coupled to the valve body structure, a portion of the manifold structure having a bore therethrough with the first end of the needle extending outwardly from the bore and beyond an end surface of the portion of the manifold structure, the manifold structure including inlet passage structure in communication with the bore and with the main fuel passage so that fuel supplied to the inlet passage structure will pass through the main flow passage and through the outlet opening when the needle is in the open position, and a bellows in the bore and constructed and arranged to prevent fuel from exiting the bore near the first end of the needle, a dry side sub-assembly comprising:

a piezo stack coupled to the manifold structure and constructed and arranged to change length when voltage is applied thereto, the piezo stack being associated with the first end of the needle so that when the length of the piezo stack changes, the needle moves from the closed position to the open position thereof, and a thrust nut and a thrust ring associated with the piezo stack, the thrust nut being threadedly engaged with the manifold structure, coupling the piezo stack to the manifold structure.

2. The injector of claim 1, further comprising a crush ring between the end surface of the portion of the manifold structure and an end surface of the piezo stack, the crush ring being constructed and arranged to set lift of the needle.

3. The injector of claim 1, wherein the piezo stack includes a plurality of stacked piezo-electric elements that increase in length when voltage is applied thereto.

4. The injector of claim 1, wherein the bellows is metal and is welded to the first end of the needle and to the portion of the manifold structure.

5. A module, direct fuel injector comprising:

a fuel side sub-assembly comprising:

valve body structure defining a main flow passage therethrough and an outlet opening, the valve body structure including a seating surface at a distal end thereof, a needle disposed in the main flow passage, the needle having first and second ends, the second end having a sealing surface associated with the seating surface, the needle being movable between a closed position with the sealing surface engaging the seating surface to prevent fuel from passing through the outlet opening, and an open position with at least a portion of the needle moving outwardly from the distal end of the valve body structure with the sealing surface being disengaged from the seating surface to permit fuel to pass through the outlet opening, a spring, disposed in the main flow passage, constructed and arranged to bias the needle to the closed position, manifold structure coupled to the valve body structure, a portion of the manifold structure having a bore therethrough with the first end of the needle extending outwardly from the bore and beyond an end surface of the portion of the manifold structure, the manifold structure including inlet passage structure in communication with the bore and with the main fuel passage so that fuel supplied to the inlet passage structure will pass through the main flow passage and through the outlet opening when the needle is in the open position, and a bellows in the bore and constructed and arranged to prevent fuel from exiting the bore near the first end of the needle, a dry side sub-assembly comprising:

a piezo stack coupled to the manifold structure and constructed and arranged to change length when voltage is applied thereto, the piezo stack being associated with the first end of the needle so that when the length of the piezo stack changes, the needle moves from the closed position to the open position thereof, wherein the manifold structure includes a body manifold and a fuel manifold coupled thereto, the body manifold being coupled to the upper valve body and including said portion of the manifold structure, and wherein the fuel manifold surrounds the body manifold, the fuel manifold including an inlet fitting for receiving a supply of fuel, an inlet passage in communication with the inlet fitting, and mounting structure disposed generally 180° from the inlet fitting.

6. The injector of claim 5, wherein the body manifold passage includes a pair of manifold passages therein disposed generally 180° apart, the manifold passages communicating with the main flow passage, wherein the fuel manifold is oriented with respect to the body manifold so that the inlet passage communicates with one of the manifold passages.

7. The injector of claim 1, wherein the valve body structure includes a lower valve body and an upper valve coupled thereto to define the main flow passage, the lower valve body defining the outlet opening and including the seating surface at a distal end thereof, the manifold structure being coupled to the upper valve body, and wherein the one end of the spring engages the lower valve body and another end of the spring engages a retainer disposed in the main flow passage.

8. A module, direct fuel injector comprising:

a fuel side sub-assembly comprising:

valve body structure defining a main flow passage therethrough and an outlet opening, the valve body structure including a seating surface at a distal end thereof, means, disposed in the main flow passage, for controlling flow through the outlet opening, the means for controlling flow having first and second ends, the second end having a sealing surface associated with the seating surface, the means for controlling flow being movable between a closed position with the sealing surface engaging the seating surface to prevent fuel from passing through the outlet opening, and an open position with at least a portion of the means for controlling flow moving outwardly from the distal end of the valve body structure with the sealing surface being disengaged from the seating surface to permit fuel to pass through the outlet opening, means, disposed in the main flow passage, constructed and arranged to bias the means for controlling flow to the closed position, manifold structure coupled to the valve body structure, a portion of the manifold structure having a bore therethrough with the first end of the means for controlling flow extending outwardly from the bore and beyond an end surface of the portion of the manifold structure, the manifold structure including inlet passage structure in communication with the bore and with the main fuel passage so that fuel supplied to the inlet passage structure will pass through the main flow passage and through the outlet opening when the means for controlling flow is in the open position, and means, in the bore and coupled to the means for controlling flow needle and to the portion of the manifold structure, for preventing fuel from exiting the bore near the first end of the means for controlling flow, a dry side sub-assembly comprising:

a piezo stack coupled to the manifold structure and constructed and arranged to change length when voltage is applied thereto, the piezo stack being associated with the first end of the means for controlling flow so that when the length of the piezo stack changes, the means for controlling flow moves from the closed position to the open position thereof, and a thrust nut and a thrust ring associated with the piezo stack, the thrust nut being threadedly engaged with the manifold structure, coupling the piezo stack to the manifold structure.

9. The injector of claim 8, further comprising a crush ring between the end surface of the portion of the manifold structure and an end surface of the piezo stack, the crush ring being constructed and arranged to set lift of the means for controlling flow.

10. The injector of claim 8, wherein the piezo stack includes a plurality of stacked piezo-electric elements that increase in length when voltage is applied thereto.

11. The injector of claim 8, wherein the means for preventing is a bellows welded to the first end of the means for controlling flow and to the portion of the manifold structure.

12. The injector of claim 8, wherein the manifold structure includes a body manifold and a fuel manifold coupled thereto, the body manifold being coupled to the upper valve body and including said portion of the manifold structure, and wherein the fuel manifold surrounds the body manifold, the fuel manifold including an inlet fitting for receiving a supply of fuel, an inlet passage in communication with the inlet fitting, and mounting structure disposed generally 180° from the inlet fitting.

13. The injector of claim 12, wherein the body manifold passage includes a pair of manifold passages therein disposed generally 180° apart, the manifold passages communicating with the main flow passage, wherein the fuel manifold is oriented with respect to the body manifold so that the inlet passage communicates with one of the manifold passages.

14. The injector of claim 8, wherein the valve body structure includes a lower valve body and an upper valve coupled thereto to define the main flow passage, the lower valve body defining the outlet opening and including the seating surface at a distal end thereof, the manifold structure being coupled to the upper valve body, and wherein the means for biasing is a spring having one end engaging the lower valve body and another end engaging a retainer disposed in the main flow passage.

15. A method of assembling a module, direct fuel injector, the method comprising:

providing a fuel side sub-assembly comprising:

valve body structure defining a main flow passage therethrough and an outlet opening, the valve body structure including a seating surface at a distal end thereof, a needle disposed in the main flow passage, the needle having first and second ends, the second end having a sealing surface associated with the seating surface, the needle being movable between a closed position with the sealing surface engaging the seating surface to prevent fuel from passing through the outlet opening, and an open position with at least a portion of the needle moving outwardly from the distal end of valve body structure with the sealing surface being disengaged from the seating surface to permit fuel to pass through the outlet opening, a spring, disposed in the main flow passage, constructed and arranged to bias the needle to the closed position, manifold structure coupled to the upper valve body, a portion of the manifold structure having a bore therethrough with the first end of the needle extending outwardly from the bore and beyond an end surface of the portion of the manifold structure, the manifold structure including inlet passage structure in communication with the bore and with the main fuel passage so that fuel supplied to the inlet passage structure will pass through the main flow passage and through the outlet opening when the needle is in the open position, and providing a pre-deformed crush ring adjacent to the end surface of the portion of the manifold structure, coupling a piezo stack, separate from the fuel side sub-assembly, to the manifold structure with an end of the piezo stack engaging the crush ring thereby setting a lift of the needle, the piezo stack being constructed and arranged to change length when voltage is applied thereto and being associated with the first end of the needle so that when the length of the piezo stack changes, the needle moves from the closed position to the open position thereof, and providing a bellows in the bore coupled to the needle and to the portion of the manifold structure, the bellows preventing fuel from exiting the bore near the first end of the needle.

16. The method of claim 15, further comprising:

setting a force of the spring prior to the step of coupling the piezo stack.

* * * * *